United States Patent [19]

Regan

[11] 4,253,905

[45] Mar. 3, 1981

[54] TAPE DISPENSER

[76] Inventor: James L. Regan, 2027 Lakeview Ter., Fairbanks, Ak. 99701

[21] Appl. No.: 110,226

[22] Filed: Jan. 7, 1980

[51] Int. Cl.[3] ..... B32B 31/18

[52] U.S. Cl. ..... 156/523; 156/577; 156/579

[58] Field of Search ..... 156/523, 526, 527, 574, 156/576, 577, 579

[56] References Cited

U.S. PATENT DOCUMENTS

| | | | |
|---|---|---|---|
| 2,722,329 | 11/1955 | Vogt | 156/523 |
| 3,150,027 | 9/1964 | Moyer | 156/523 |
| 3,725,182 | 4/1973 | Regan | 156/527 |
| 3,850,779 | 11/1974 | Pearson | 156/523 |
| 4,104,110 | 8/1978 | Macosko | 156/523 |

*Primary Examiner*—Michael G. Wityshyn

[57] ABSTRACT

A hand-held tape dispenser has a main frame supporting a tape roll feeding tape outwardly along a pivotal guide shoe past a pivotal cutter edge on a blade movable between a retracted position and an extended position; a thumb slide is drivingly connected to the blade to pivot it to its extended position and a finger operated lever operates at the completion of a tape dispensing operation firstly for clamping the tape against the tape guide shoe and secondly for rapidly moving the tape guide means to a retracted position spaced inwardly of said tape cutter edge when said tape cutter edge is in its extended position to tension the tape against the cutter edge to effect severing of the tape and provide a tape end tab extending outwardly of said dispenser upon return of the cutter edge to its retracted position. Another embodiment employs a pivotal blade support to which an attachment blade is removably connected; the attachment blade has a cushion of foam rubber on its outer face for forcing dispensed tape into difficult to reach areas.

16 Claims, 10 Drawing Figures

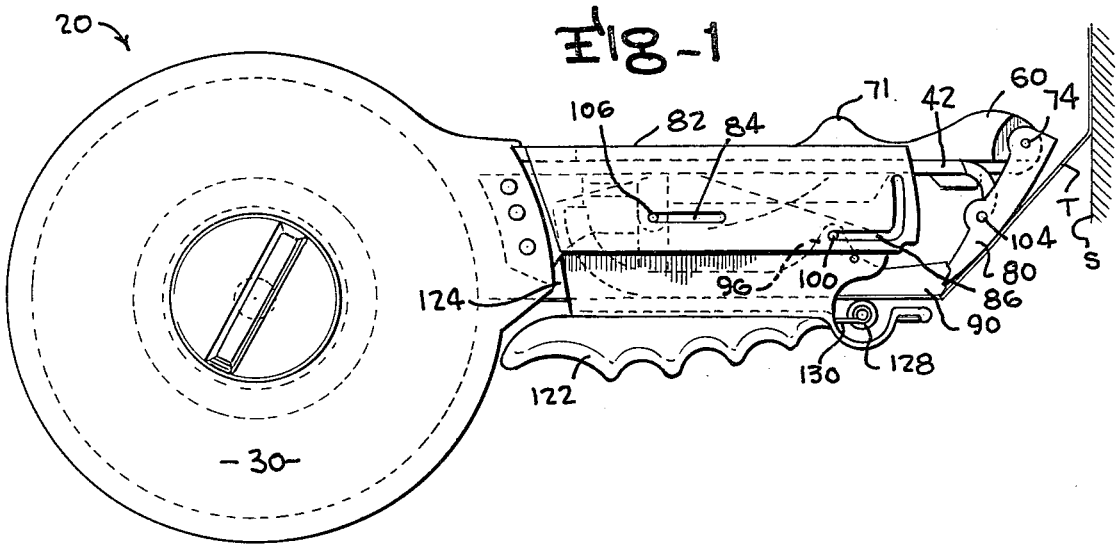
Fig-1
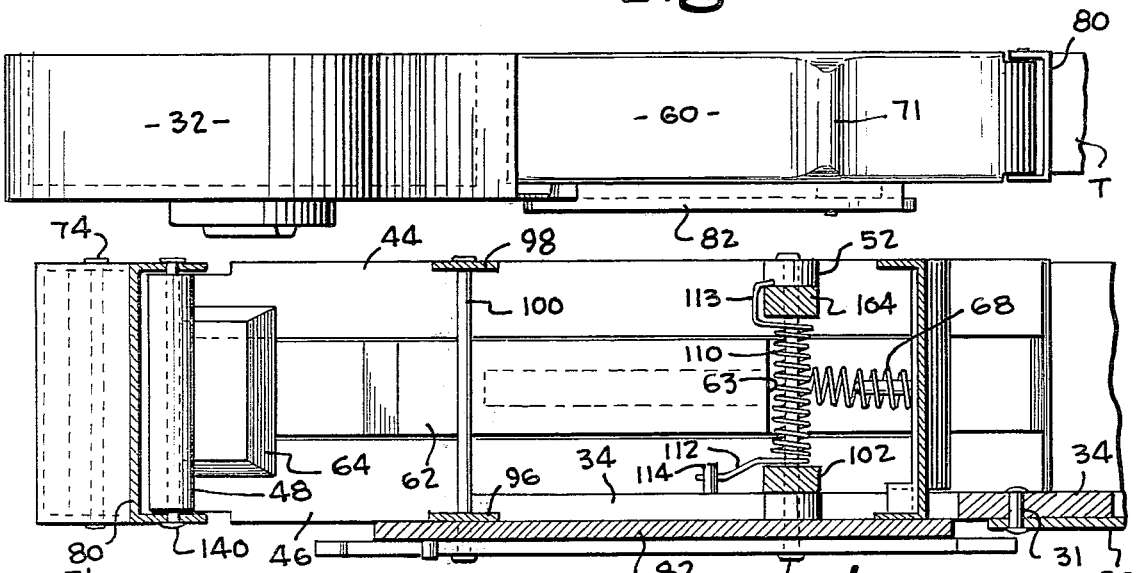
Fig-2
Fig-6
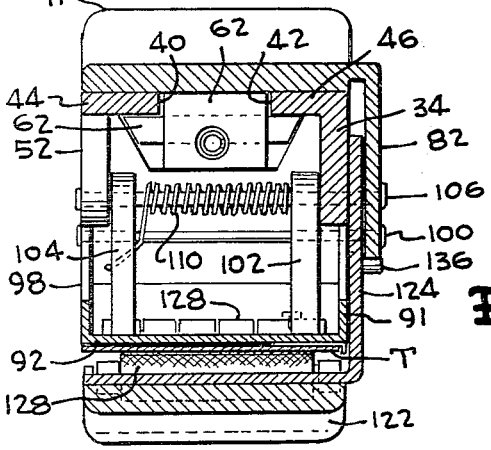
Fig-7

TAPE DISPENSER

This invention is in the field of tape dispensing and is more particularly directed to a hand-held tape dispenser for dispensing pressure-sensitive tape into restricted inaccessible areas. The prior art is replete with a wide variety of tape dispensing devices with the most common type comprising a roll support and a fixed cutting edge in which the tape is manually pulled from the roll and severed by manual movement against the cutting edge. While the foregoing type of tape dispenser is satisfactory for desk-top use, there has been an ever increasing demand for hand-held tape dispensers fo dispensing masking tape and the like into inaccessible areas such as when taping windows or the like or masking prior to painting. The invention of my prior U.S. Pat. No. 3,725,182 is directed to a device for dispensing tape and including a cutter blade for cutting the tape following the termination of the dispensing operation. However, it has been found that the device is sometimes incapable of applying tape in restricted areas and for providing an accurate cut of the tape at the exact desired location due to the fact that the fixedly positioned knife blade cutting edge cannot be positioned in some restricted areas. While it would be possible to redesign the knife to provide for positioning of the cutting edge in an extended outward position, the blade would then be easily susceptible to accidental damage if the device were dropped or mishandled and might also contribute to injury to the user in such event.

Another disadvantage of my prior device as well as other known devices is that beginning a new dispensing operation is sometimes difficult due to the fact that the free end of the tape is inaccessibly positioned as a result of the last preceeding severing operation. More specifically, the end of the tape is adjacent the serrated knife edge and must be separated therefrom before the next dispensing operation.

Therefore, it is the primary object of this invention to provide a new and improved tape dispensing means.

Another object of the present invention is the provision of a new and improved tape dispenser and applicator capable of applying tape in restricted areas.

A further object of the present invention is to provide a new and improved tape dispensing means which will provide a newly cut tape end following a severing operation in an accessible position where the tape end can be readily grasped for the next succeeding tape dispensing operation.

Achievement of the foregoing objects is enabled by the preferred embodiment of the present invention through the provision of a movable tape severing blade which is pivoted outwardly about a pivot axis parallel to the axis of the tape roll by means of a thumb operated slide on the top of the device. When the blade is pivoted to its outward position, it can easily be manipulated to position the tape into recessed corners or the like. Additionally, a finger operated handle on the dispenser is then operated to clamp the tape and sever the tape at the exact location of the cutting edge of the knife in its extended position. Following completion of the severing operation, the knife pivots back inwardly to position its cutting edge away from the cut end of the tape in a recessed area to provide an end tab on the tape protruding outwardly in a position in which it can be easily grasped by the user for the next tape dispensing operation.

A better understanding of the manner in which the preferred embodiment achieves the foregoing objects will be enabled when the following detailed description is considered in conjunction with the appended drawings in which like reference numerals are employed for the same parts in the different figures.

DESCRIPTION OF THE DRAWINGS

FIG. 1 is a side elevation view of the preferred embodiment as employed in a tape dispending operation;

FIG. 2 is a top plan view thereof;

FIG. 6 is a sectional view taken along the lines 6—6 of FIG. 3;

FIG. 7 is a sectional view taken along lines 7—7 of FIG. 3;

DESCRIPTION OF THE PREFERRED EMBODIMENT

The preferred embodiment of the invention, which is generally designated 20, as illustrated in FIG. 1, comprises a hand-held tape dispenser from which tape T is dispensed for application to a desired surface such as surface S. The tape to be dispensed is stored in a roll 24 on the interior of the dispenser in the exact same manner as the roll 24 of my earlier U.S. Pat. No. 3,725,182.

Figures 8, 9, 10:
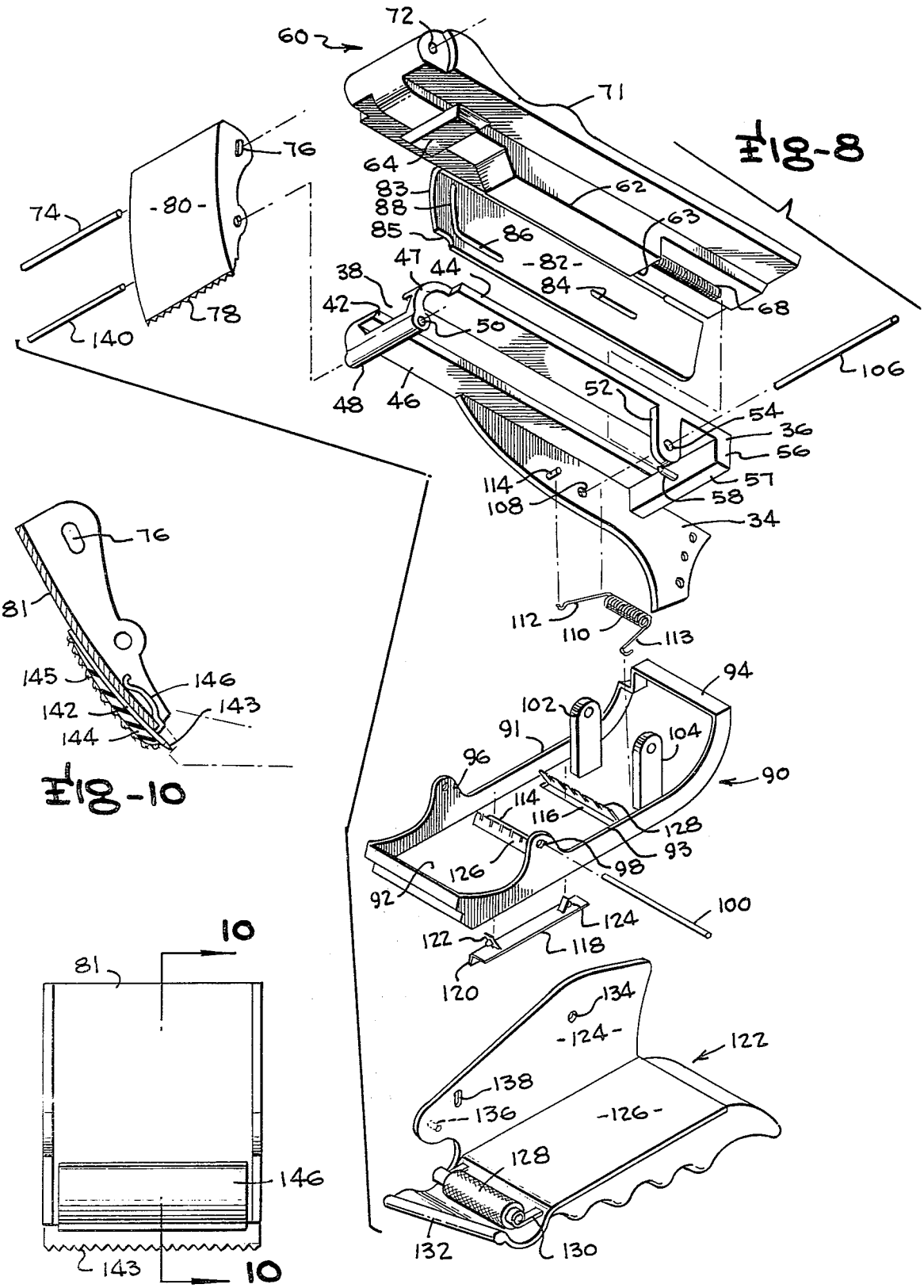
FIG. 8 is an exploded perspective view of the operative components of the preferred embodiment.
FIG. 9 is a front elevation view of an alternative blade construction.
FIG. 10 is a sectional view taken along lines 10—10 of FIG. 9.

The preferred embodiment includes supporting frame means for supporting the various movable components of the device with the supporting frame means including a base plate 30 from which a tape enclosing peripheral flange 32 extends in surrounding relation with respect to the roll 24. A cantilever plate 34 is fixedly connected to the base plate 30 by rivets 31 or the like and extends outwardly therefrom with a slide guide frame 36 being formed unitarily with the cantilever plate 34 along the upper edge surface thereof as best shown in FIG. 8. A linear guide slot 38 is formed in the upper surface of the slide guide frame 36 between the edges 40 and 42 of first and second top plate components 44 and 46 of the slide guide frame 36. The forward end of the slide guide frame 36 curves downwardly and terminates in a rounded blade support boss 48 having a transverse bore 50. A downwardly extending leg plate 52 having an aperture 54 and a stop plate 56 having a bottom surface 57 and a spring mount pin 58 are provided adjacent the rear end of the slide guide frame 36. It will be observed that the connection between the first top plate 44 and the second top plate 46 is provided at the extreme ends of these plates respectively by the curved elements 47 and blade support boss 48 on one end and the stop plate 56 on the other end.

A thumb actuated slide 60 is mounted for reciprocation on the slide guide frame 36 and includes a downwardly extending guide lug 62 positioned in the slot 38 with a transverse retainer lug 64 being mounted adjacent the forward end of the guide lug 62 and extending beneath the top plates 44 and 46 for holding the forward end of the thumb actuated slide 60 in position on the slide guide frame 36 while permitting the thumb actuated slide 60 to be axially reciprocated. A compression spring 68 mounted on the spring mount pin 58 engages the rearmost end surface 63 of the elongated guide lug 62 so as to bias the guide lug and other portions of the thumb actuated slide 60 to the left as viewed in FIGS. 3 through 5. The upper surface of the thumb actuated slide 60 is contoured to include a depression at 70 and a protrusion 71 for receiving the thumb of a user as shown in FIG. 5. A transverse aperture 72 adjacent the forward end portion of the thumb actuated slide 60 receives a blade actuator pin 74 having outer ends extending through elongated slots 76 provided in side flanges of a tape applicator and cutting blade 80 of curved configuration as best shown in FIGS. 8 and 10. A control plate 82 extends downwardly from along one side of the thumb actuated slide 60 and includes a horizontal linear slide groove 84 in its rear portion and an L-shaped groove formed of a horizontal component 86 and a vertical component 88 in its forward portion, the purposes of which will become apparent hereinafter.

A tape guide shoe 90 is positioned beneath the slide guide frame 36 and includes a bottom plate 92 having upwardly curved ends and side plates 91 and 93; an abutment plate 94 is normally engaged with the lower surface 57 of the stop plate 56. Additionally, the tape guide shoe 90 includes forwardly positioned ears 96 and 98 through which a guide pin 100 extends. The guide pin 100 also extends through the L-shaped slot formed in the control plate 82 and is normally in the horizontal component 86 of the slot. Support lugs 102 and 104 extend upwardly from the rear portion of the tape guide shoe 90 and have aligned apertures through which a pivot pin 106 extends.

Pivot pin 106 is also mounted in the aperture 54 of lug plate 52 and an aligned aperture 108 in the cantilever plate 34 as best shown in FIG. 8. A coil spring 110 has one end 112 engaged with a lug 114 on cantilever plate 34 and has its opposite end 113 engaged with the forward edge of the support lug 104 so that the effect of spring 110 is to tend to rotate the tape guide shoe 90 in a counter clockwise direction about the pin 106 as viewed in FIG. 3. It will also be observed that the coil spring 110 is positioned on the pivot pin 106.

The tape guide shoe 90 also includes spaced parallel slots 114 and 116 provided in the curved bottom plate 92 for permitting the adjustable mounting of a tape edge guide 118 which is positionable in different transverse positions on the curved bottom plate 92 in accordance with the width of the tape being dispensed from roll 24. The tape side edge guide 118 has a side flange 120 which engages the edge of the tape and also has first and second retainer tabs 122 and 124 which extend up through the slots 114 and 116 respectively to engage slots in positioner plates 126 and 128 respectively provided adjacent the slots 114 and 116. The tape edge guide 118 can consequently be positioned in any desired one of a plurality of transverse locations on the curved bottom plate 92.

A tape clamp actuator handle 122 is positioned beneath the tape guide chute 90 and includes a side plate 124 and a bottom plate 126. A knurled roller 128 is supported at opposite ends by cantilever springs 130 with a canted clamp rod 132 defining the forward extend of the tape clamp actuator handle 122. A mounting aperture 134 in the side plate 124 is attached to the pivot pin 106, which also extends through the linear slot 84 on control plate 82; a guide pin 136 on the forward end of side plate 124 is positioned in the L-shaped slot formed of horizontal component 86 and vertical component 88 in the control plate 82. A relatively short elongated slot 138 receives or is mounted on the guide pin 100.

Support for the tape applicator and cutting blade 80 is provided by a blade support pivot pin 140 positioned in the transverse bore 50 on the forward end of the slide guide frame 36. It will be observed that the lower edge of blade 80 is serrated for effectively cutting the tape. Additionally, FIGS. 9 and 10 illustrate an optional version of the blade in which a removable cutter blade 142 having a serrated lower edge 143 has a cushion member 144 formed of foam rubber and covered with a cloth cover 145 is held in position on a support blade 81 by spring 146. The cushion pad 144 permits the tape to be forced into uneven areas to permit an optimum adhesion of the tape to the area in which it is being applied. It will be observed that the tape guide shoe 90 includes a stepped recess 95 in which the serrated cutting edge 78 of blade 80 or the cutting edge 143 of the alternative blade are safely positioned when the device is in the condition shown in FIG. 3.

Figure 3:
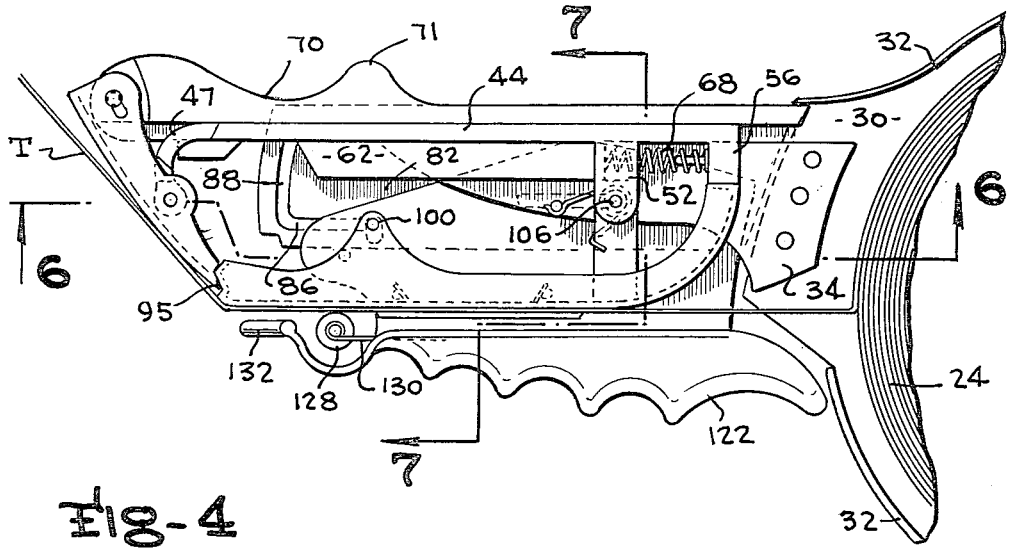
FIG. 3 is an enlarged side elevation view of a portion of the preferred embodiment illustrating the parts in their normal position for dispensing tape.

In operation, the preferred embodiment is employed to dispense tape T to a surface S with the parts being in the positions illustrated in FIGS. 1 and 3. The parts are held in the illustrated position by operation of spring 68 and spring 110 with spring 68 urging the thumb actuated slide 60 to the left as viewed in FIG. 3 to position the serrated cutting edge 78 in the stepped recess 95 which positioning limits the extent of leftward movement of the slide 60. If it becomes desirable to dispense the tape into a corner or recess area, the user pulls slide 60 rearwardly with his thumb from the dotted line position to the solid line position of FIG. 4 to consequently result in pivotal movement of the blade 80 from the dotted line to the solid line position of the same figure. Movement of the blade to the FIG. 4 position permits the blade tip to position the tape into recessed areas such as corners or the like. When it is desired to sever the tape, the user first actuates the thumb actuated slide 60 to move it to the extreme rearward position illustrated in FIG. 5 with such movement being permitted by virtue of the fact that pin 100 is located in the horizontal slot component 86 and pin 106 is positioned in the horizontal slot 84. When the thumb actuated slide 60 reaches its rearmost extent of movement illustrated in FIG. 5, pin 100 is then beneath the vertical slot component 88 and the user pulls upwardly with his fingers on the finger actuated tape clamp actuator handle 122 to effect movement of the pin 100 upwardly in the vertical slot component 88 to the top thereof as shown in FIG. 5. It will be observed that the handle 122 pivots about the axis of pin 106 and the initial movement of the handle 122 from the position of FIG. 3 is not transmitted to the tape guide shoe 90 by virtue of the fact that slot 138 provides limited free movement of pin 100 with the initial upward movement of the tape clamp actuator handle 122 causing the handle to pivot about the axis of pin 106 to move the slot 138 upward until the pin 100 reaches the lower extent of the slot. When the pivotal movement of tape clamp actuator handle 122 brings the pin 100 into the lower extent of slot 138, subsequent pivotal movement of member 122 moves pin 100 upwardly in the vertical slot component 88 while guide pin 136 moves upwardly along outer end surfaces 83 of control plate 82. When the parts are in the intermediate position of FIG. 4, the pin 136 is in the stepped recess 85 so that the clamp rod 132 lightly clamps the tape between itself and the bottom plate 92 of the tape guide shoe 90 to hold the tape while the blade 80 is used for pressing the dispensed tape into corners, crevices or the like as required by the particular installation. When the parts are moved to the position illustrated in FIG. 5, substantial pressure is applied to the tape by clamp rod 132 so that upward movement of the forward end of the guide shoe tensions the tape against cutting edge 78 to result in the severing of the tape to leave a free tab end T' of tape extending downwardly from the clamp rod 132. Upon release of the handle 122 and the slide 60 to permit the parts to return to their FIG. 3 position, the free tab T' is available to be easily grasped by the user for initiating a subsequent application of tape from roll 24 in an obvious manner.

Figure 4:
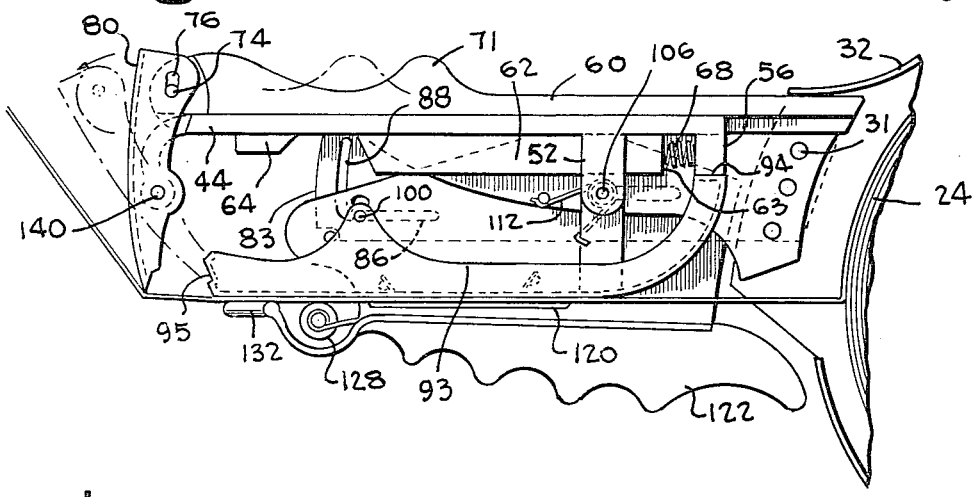
FIG. 4 is similar to FIG. 3 but illustrates the parts in a subsequent position in which the cutter blade is pivoted outwardly for permitting its use in effectively positioning the dispensed tape.
Figure 5:
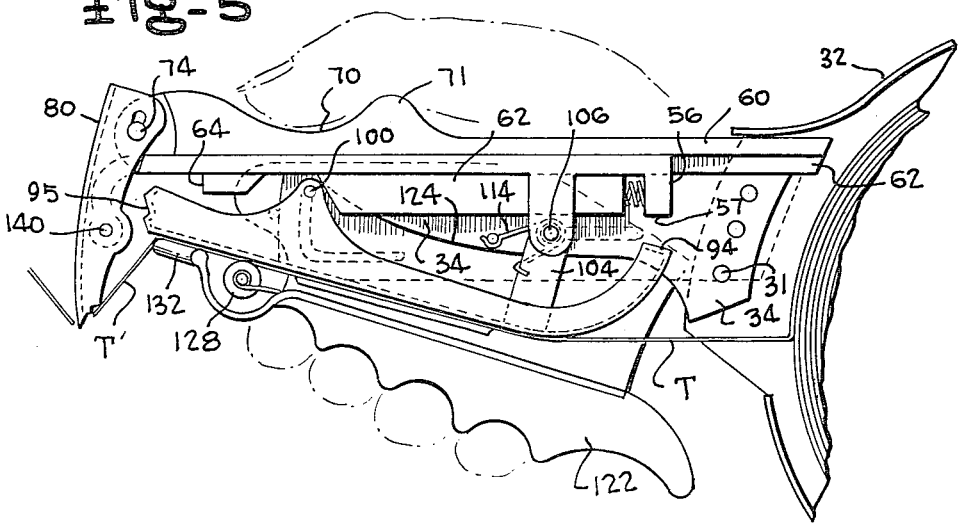
FIG. 5 is similar to FIG. 4 but illustrates the parts in a subsequent position at the moment of severing of the tape by the cutter blade.

Thus, the preferred embodiment permits the cutter blade 80 to be easily pivoted to the intermediate position of FIG. 4 to aid in positioning of the dispensed tape while still retaining the ability to quickly move the guide means to the position of FIG. 5 to effectively sever the tape while retaining the tab member T' for making subsequent usage of the dispenser substantially more convenient.

It should be understood that the terms "horizontal" and "vertical" as used herein refer to the components when oriented in the manner of FIG. 3 while "front" and "rear" respectively refer to the blade end (the left end of FIG. 3) and the tape roll end (the right end of FIG. 3).

Numerous modifications of the preferred embodiment will undoubtedly occur to those of skill in the art and it should be understood that the spirit and scope of the invention is to be limited solely by the appended claims.

I claim:

1. A hand-held tape dispenser comprising a main frame, a tape roll of pressure-sensitive tape having adhesive means on one side supported on said main frame, a pivotal tape positioning and severing cutter edge positioned outwardly of said roll of pressure-sensitive tape, cutter edge moving means for moving said cutter edge between a retracted position and an extended tape positioning and severing position, tape guide means for guiding tape being dispensed from the roll outwardly beyond the cutting edge and actuator means operable at the completion of said tape dispensing operation firstly for clamping the tape against the tape guide means and secondly for rapidly moving said tape guide means to a second position spaced inwardly of said tape cutter edge when said tape cutter edge is in its extended position to tension the tape against the cutter edge to effect severing of the tape and provide a tape end tab extending outwardly of said dispenser upon return of the cutter edge to its retracted position.

2. The invention of claim 1 wherein said tape guide means includes a pivotal tape guide shoe mounted for pivotal movement on the main frame and having a bottom plate component positioned to be engaged by the non-adhesive side of tape extending from said tape roll and said actuator means includes finger operated handle means for clamping said tape against said bottom plate component.

3. The invention of claim 1 wherein said main frame includes an elongated slide guide frame having an upper surface, a slide guide slot extending downwardly from said upper surface and wherein said cutter edge moving means comprises a thumb-actuated slide mounted on said upper surface for movement between a rearward position and a forward position and including downwardly extending guide lug means positioned in said slide guide slot.

4. The invention of claim 3 wherein said tape guide means includes a tape guide shoe including a forwardly to rearwardly extending bottom plate positioned adjacent tape extending from the tape roll, main pivot means supporting a rearward position of said tape guide shoe for permitting pivotal movement of the tape guide shoe about a transverse axis beneath a rearward portion of said elongated slide guide frame, and wherein said actuator means includes a finger-actuated tape clamp actuator handle pivotally supported on said main pivot means in a position beneath said bottom plate of the tape guide shoe.

5. The invention of claim 3 wherein said cutter edge is provided on a pivotal blade mounted on a blade support pivot pin on a forward portion of said elongated slide guide frame.

6. The invention of claim 5 wherein said tape guide means includes a tape guide shoe including a forwardly to rearwardly extending bottom plate positioned adjacent tape extending from the tape roll, main pivot means supporting a rearward portion of said tape guide shoe for permitting pivotal movement of the tape guide shoe about a transverse axis beneath a rearward portion of said elongated slide guide frame, and wherein said actuator means includes a finger-actuated tape clamp actuator handle pivotally supported on said main pivot means in a position beneath said bottom plate of the tape guide shoe.

7. The invention of claim 6 additionally including interconnection means between said thumb-actuated slide and said tape guide shoe for permitting pivotal movement of said tape guide shoe about said main pivot means only when said thumb-actuated slide is in its rearward position.

8. The invention of claim 5 additionally including means for providing a pivot drive connection between the forward end of said thumb-actuated slide and said pivotal blade for pivoting the cutter edge to its extended position in response to movement of the thumb-actuated slide to its rearward position.

9. The invention of claim 8 wherein said tape guide means includes a tape guide shoe including a forwardly to rearwardly extending bottom plate positioned adjacent tape extending from the tape roll, main pivot means supporting a rearward portion of said tape guide shoe for permitting pivotal movement of the tape guide shoe about a transverse axis beneath a rearward portion of said elongated slide guide frame, and wherein said actuator means includes a finger-actuated tape clamp actuator handle pivotally supported on said main pivot means in a position beneath said bottom plate of the tape guide shoe.

10. The invention of claim 9 additionally including interconnection means between said thumb-actuated slide and said tape guide shoe for permitting pivotal movement of said tape guide shoe about said main pivot means only when said thumb-actuated slide is in its rearward position.

11. The invention of claim 3 wherein said cutter edge is provided on a removable cutter blade removably attached to a pivotal support blade mounted for pivotal movement on a blade support pivot pin on a forward portion of said elongated slide guide frame and further including a cushion member attached to an outer face of the removable cutter blade adjacent said cutter edge for forcing dispensed tape into contact with recessed surfaces to which it is desired to apply the tape.

12. The invention of claim 11 wherein said tape guide means includes a tape guide shoe including a forwardly to rearwardly extending bottom plate positioned adjacent tape extending from the tape roll, main pivot means supporting a rearward portion of said tape guide shoe for permitting pivotal movement of the tape guide shoe about a transverse axis beneath a rearward portion of said elongated slide guide frame, and wherein said actuator means includes a finger-actuated tape clamp actuator handle pivotally supported on said main pivot means in a position beneath said bottom plate of the tape guide shoe.

13. The invention of claim 12 additionally including interconnection means between said thumb-actuated slide and said tape guide shoe for permitting pivotal movement of said tape guide shoe about said main pivot means only when said thumb-actuated slide is in its rearward position.

14. The invention of claim 11 wherein said cutter edge is serrated and said cutter blade is held in position on said pivotal support blade by spring means.

15. A tape dispenser comprising support means supporting a roll of pressure-sensitive tape having adhesive on one side thereof, guide means for guiding tape outwardly from the roll past a tape cutter blade having a cutting edge, means supporting said tape cutter blade for pivotal movement about a pivot axis parallel to the axis of said roll of pressure-sensitive tape between a retracted position in which said cutting edge is positioned in a protected retracted position against said guide means and an extended position in which said cutting edge is spaced outwardly of and away from said guide means, thumb-actuated slide means for moving said cutter blade from its retracted position to its extended position and finger-actuated clamping means operable for clamping said tape to said guide means and for moving said guide means inwardly of said cutting edge while said tape is clamped by the clamping means to effect cutting of the tape by the cutting edge while the blade is in its extended position to provide a tape end tab freely extending outwardly of the guide means so as to be easily grasped for a subsequent tape dispensing operation.

16. The invention of claim 15 wherein said means supporting said tape cutter blade comprises a support blade having an outer face and a lower edge termination, said tape cutter blade including spring means for clamping said tape cutter blade to said outer face of the support blade over said lower edge termination and cushion means attached to the cutter blade adjacent the cutting edge for use in forcing dispensed tape into recessed areas.

* * * * *